US008820270B2

(12) United States Patent
Snow

(10) Patent No.: US 8,820,270 B2
(45) Date of Patent: Sep. 2, 2014

(54) WATER INJECTION SYSTEM USING WATER RECLAIMED FROM COMBUSTION EXHAUST

(71) Applicant: Matt Snow, Woodland Park, CO (US)

(72) Inventor: Matt Snow, Woodland Park, CO (US)

( * ) Notice: Subject to any disclaimer, the term of this patent is extended or adjusted under 35 U.S.C. 154(b) by 0 days.

(21) Appl. No.: 13/759,459

(22) Filed: Feb. 5, 2013

(65) Prior Publication Data

US 2014/0048619 A1 Feb. 20, 2014

Related U.S. Application Data

(63) Continuation-in-part of application No. 12/849,014, filed on Aug. 2, 2010, now Pat. No. 8,561,579.

(60) Provisional application No. 61/595,508, filed on Feb. 6, 2012.

(51) Int. Cl.

| | |
|---|---|
| ***F02B 47/02*** | (2006.01) |
| ***F02M 25/022*** | (2006.01) |
| ***F02D 41/28*** | (2006.01) |
| ***F02D 41/00*** | (2006.01) |
| ***F02M 43/00*** | (2006.01) |
| ***F02D 41/24*** | (2006.01) |
| ***F02M 25/028*** | (2006.01) |
| *F02M 69/04* | (2006.01) |

(52) U.S. Cl.

CPC ..... *F02M 25/028* (2013.01); *F02D 2400/11* (2013.01); *F02M 25/022* (2013.01); *F02D 41/28* (2013.01); *F02D 41/0025* (2013.01); *F02M 69/043* (2013.01); *F02M 43/00* (2013.01); *F02D 41/2429* (2013.01)

USPC ..... 123/25 A

(58) Field of Classification Search

CPC ..... F02C 7/1435; F02B 47/02; F02B 47/08; F02M 25/0228; F02M 25/0222; F02M 43/00; F05D 2260/212

USPC ..... 123/25 A, 25 E, 25 F

See application file for complete search history.

(56) References Cited

U.S. PATENT DOCUMENTS

| | | | | |
|---|---|---|---|---|
| 7,599,775 | B2 * | 10/2009 | Furuno | 701/50 |
| 7,953,530 | B1 * | 5/2011 | Pederson et al. | 701/31.7 |
| 8,065,870 | B2 * | 11/2011 | Jobson et al. | 60/295 |
| 8,511,111 | B2 * | 8/2013 | Lambert et al. | 62/476 |
| 2009/0214415 | A1 * | 8/2009 | Jew et al. | 423/579 |
| 2011/0113761 | A1 * | 5/2011 | Boorse et al. | 60/297 |
| 2011/0168128 | A1 * | 7/2011 | Bradley et al. | 123/294 |
| 2011/0265474 | A1 * | 11/2011 | Schubert | 60/641.9 |

OTHER PUBLICATIONS

Aquamist System 2d, May 30, 2007, 2 pages, published by Aquamist; webiste located at: http://www.aquamist.co.uk/cp/806-009/806-009.html; This is a 3-D water/alcohol injection system adapted to keep track of fuel flow.

(Continued)

*Primary Examiner* — Noah Kamen
*Assistant Examiner* — Long T Tran
(74) *Attorney, Agent, or Firm* — Leyendecker & Lemire, LLC

(57) ABSTRACT

An injection system for injecting one or both of water and alcohol into an internal combustion engine includes a system monitor, a control module, a mixture delivery system, and a water reclamation system. The system monitor can have a parameter level display. The control module can be adapted to receive and store one or more user-supplied parameters. The water reclamation system can comprise a means to recover water from exhaust of an internal combustion engine utilizing capillary condensation.

14 Claims, 8 Drawing Sheets

(56) References Cited

OTHER PUBLICATIONS

Aquamist System 2s, May 30, 2007, 2 pages, published by Aquamist; webiste located at: http://www.aquamist.co.uk/cp/sys2/sys2a.html; This is a water/alcohol injection system adapted to detect blocked water jets.

America's Next Top Energy Innovator Challenge, 2 pages, published by Department of Energy, website located at: http://www.doe.gov/americas-next-top-energy-innovator/borla-performance-industries-inc; Description of Borla Performance Industries, Inc. diesel exhaust technology.

Tiffany Kaiser, Capillary Condensation Used to Recover Water from Diesel Exhaust, Apr. 7, 2011, 1 page, published by DailyTech.com, website located at: http://www.google.com/patents/US20070000053?dq=20070000053&ei=wzARUebKFKi3ywHtyoGYCQ; Description of using capillary condensation to reclaim water from exhaust.

John Roach, Water Harvested from Diesel Exhaust, Feb. 2, 2012, 2 pages, published by MSNBC.com, website located at: http://cosmiclog.nbcnews.com/_news/2011/04/06/6419789-water-harvested-from-diesel-exhaust?lite; Description of harvesting water from diesel exhaust.

* cited by examiner

WATER INJECTION SYSTEM USING WATER RECLAIMED FROM COMBUSTION EXHAUST

CROSS-REFERENCE TO RELATED APPLICATIONS

The present application claims the benefit of U.S. Provisional Application No. 61/595,508, filed 6 Feb. 2012.

The present application is a continuation-in-part of, and claims priority to, application Ser. No. 12/849,014, filed on 2 Aug. 2010, the full disclosure of which is incorporated herein by reference. Application Ser. No. 12/849,014 is a divisional of, and claims priority to, U.S. Pat. No. 7,779,817, issued on 24 Aug. 2010, the full disclosure of which is incorporated herein by reference. U.S. Pat. No. 7,779,817 incorporates fully by reference Provisional Application No. 60/597,266, filed on 18 Nov. 2005 and U.S. Pat. No. 7,581,516, issued on 1 Sep. 2009, each of which has the same inventor as the present application.

FIELD OF THE INVENTION

This invention generally relates to water/alcohol injection systems.

BACKGROUND

Water/alcohol injection systems for use in internal combustion engines are known in the art. These systems provide users of such devices with significant vehicle power advantages. By injecting water and alcohol to the fuel-air mixture entering the combustion chamber, an engine's power output can be greatly increased while simultaneously decreasing the combustion chamber's temperature.

Although these are just two of the benefits that one can obtain when using prior art water/alcohol-injection systems, prior art systems are limited in many respects. For example, current water/alcohol injection systems require a user to perform a significant manual "tuning" of the system upon installation. Tuning a system upon installation of a water/alcohol system is time consuming and can be difficult to perform correctly, especially for a novice of automotive upgrades.

Additionally, prior art water/alcohol injection systems do not automatically inject an amount of mixture calculated to maximize the power output at any given engine state. For example, prior art injection system controllers generally lack the capacity to provide a precise amount of water/alcohol mixture to create the maximum power without creating engine "knocking". Engine knocking occurs when the air/fuel mixture in the cylinder has been ignited and the typical smooth burning within the chamber is interrupted by the unburned mixture in the combustion chamber exploding before the flame front can reach it. The resulting shock wave creates a knocking sound against the chamber walls.

Prior art systems are additionally defective in their display of operational data to the user and the features they provide. Many prior art systems do not provide the user with information the user needs to continually run the system in the most efficient manner possible. Also, prior art systems do not allow active and real-time or near real-time control of injection of a water/alcohol mixture.

Furthermore, prior art systems require a user to refill a reservoir with the water/alcohol mixture. When the injection system is low on fluids, the user must refill the tank. Although simple, it can be burdensome to constantly fill the system reservoir with the water/alcohol mixture.

DETAILED DESCRIPTION

Figure 1A:
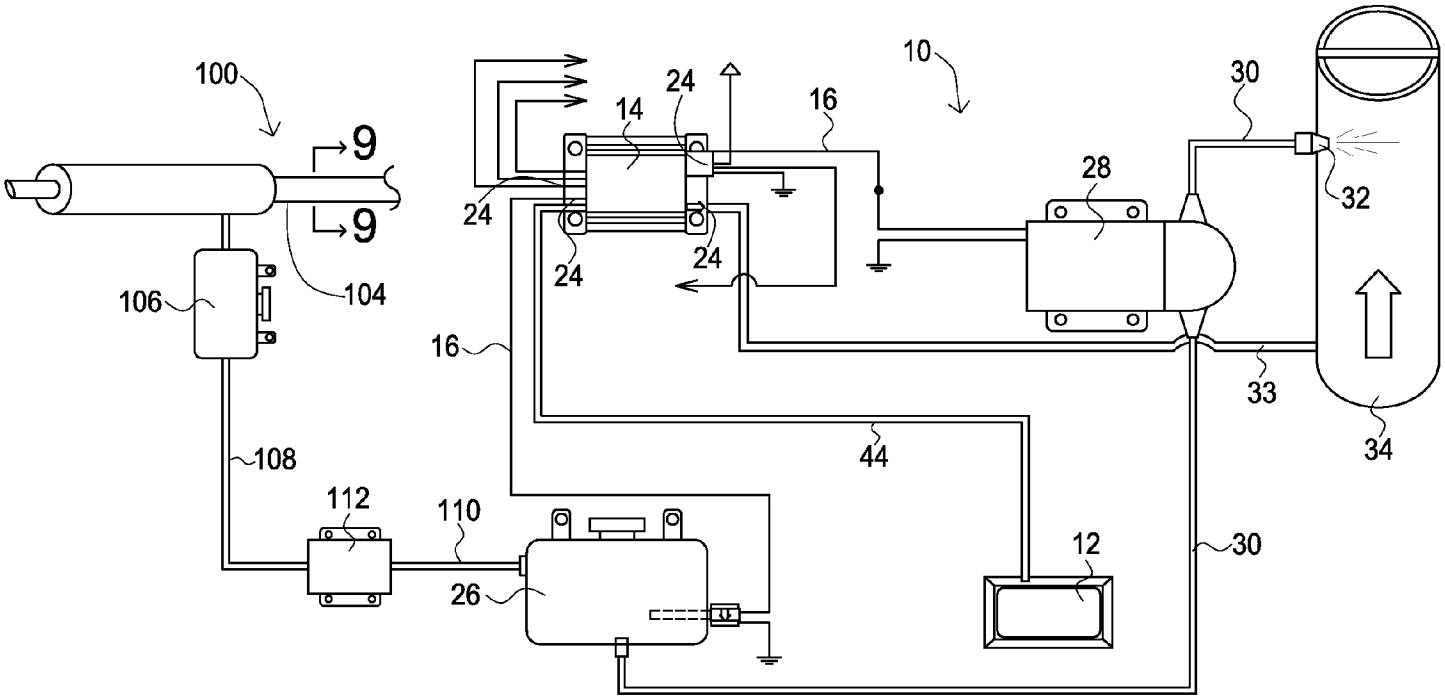
FIG. 1A is a diagram of a water/alcohol injection system coupled to an internal combustion engine according to one embodiment of the present invention.
Figure 9:
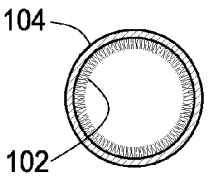
FIG. 9 is a cross-sectional view of an exhaust pipe lined with a nano-pore membrane according to one embodiment of the present invention.

Embodiments of the present invention include a water or water/methanol injection system for use with internal combustion engines, such as diesel engines, wherein the system obtains all or part of the water used by reclaiming water from engine exhaust. In at least one embodiment, water is collected from the exhaust using a process known as capillary condensation. The extracted water is typically stored in a reservoir to be pumped there from and injected into an engine as needed to maximize one or both of economy and performance. In certain embodiments, a closed loop system can be created. In the closed loop system, the user/operator of the engine may not have to add water to the reservoir from an external source as is currently required with prior art injection systems.

Broadly, embodiments of the invention comprise a water or water/alcohol injection system incorporating a means to recover water from the exhaust of an internal combustion engine. More specifically, embodiments comprise an injection system wherein the water recovery system utilizes capillary condensation to recover water. Even more specifically, embodiments comprise an injection system wherein the interior of one or more pipes of the exhaust system include a nano-pore membrane that collects water from exhaust gasses. The specific design of the water injection portion of the system can vary significantly in ways that are well known in the art.

One embodiment of a water/alcohol injection tuning system requires minimum system tuning upon installation into a vehicle. Once user-supplied parameters are correctly entered into a system component such as, but not limited to, system software, the injection system can automatically perform many steps which were previously required to be manually performed in prior art systems. For example, in one embodiment, after installing the mechanical components to a vehicle, powering on the system, and subsequently inputting parameters into the system software, the injection system can automatically inject an amount of water and alcohol into the engine to increase power output to an optimum maximum level for a given engine and injection system state.

The subject matter can be embodied as devices, systems, methods, and/or computer program products. Accordingly, some or all of the subject matter can be embodied in hardware and/or in software (including firmware, resident software, micro-code, state machines, gate arrays, etc.). Furthermore, the subject matter can take the form of a computer program product on a computer-usable or computer-readable storage medium having computer-usable or computer-readable program code embodied in the medium for use by or in connection with an instruction execution system.

In one embodiment, after a user inputs a mixture injection initiation point into the software, the injection system can begin to inject an amount of water/alcohol mixture into an engine air intake compartment. The mixture injection amount can be initiated at a system parameter setting such as, but not limited to, a boost initiation pressure, which can be the intake valve pressure level as set by the user. The injection system can receive additional user-supplied parameters such as, but not limited to, an estimated flywheel horsepower of the vehicle, a number and type of nozzle to be used in the injection system to inject the mixture into the engine, and a pump type. These parameters can be used by the injection system to determine a mixture injection amount to maximize power output.

Installation of the injection system can include installing electrical and mechanical components such as, but not limited to, a mixture delivery system, a system monitor, a control module, and a water reclamation system. The delivery system, system monitor, control module, and water reclamation system can be operatively coupled to each other and/or other system components through electrical wiring and/or tubing. In an embodiment, the delivery system can be comprised of a mixture supply container such as, but not limited to, a reservoir or tank. The delivery system can include a pump operatively coupled to the tank and a nozzle. The control module can be operatively coupled to the system monitor and the pump. The water reclamation system can be operatively coupled to the delivery system and the control module.

In an embodiment, the system monitor can be comprised of a liquid crystal display (LCD). For example, the LCD can be a dashboard mounted touch-screen display adapted to receive input parameters from a user. The monitor can be operatively coupled to the control module through electrical wiring which can allow the monitor to transfer user-supplied parameters to the control module. Generally, the control module can be comprised of a microprocessor and a housing.

In one embodiment, the tank, pump, and control module are coupled to the inside of an engine compartment of a vehicle. One or more nozzles can be coupled to the engine air intake compartment such as an intake manifold. The system module can receive power from a vehicle key-on source. Generally, when power is supplied to the vehicle through turning an ignition key, the control module can receive electrical power and can supply power to the pump and system monitor.

The system monitor can provide a user with three screen options when powered-on. One screen can be a monitor screen, one screen can be a set-up screen, and one screen can be a display screen. Each screen can allow the user to input, view, or change different system variables in real-time or near real-time. In one embodiment, when system installation and user input parameters are saved, the alcohol-water mixture can be injected into the intake manifold at a user-specified injection initiation point including, but not limited to, the specified boost pressure level previously disclosed.

Upon initiating mixture injection into the engine, the system can receive data from at least one engine component including, but not limited to, a fuel injector. The data can be used by the control module to determine the amount of mixture to supply to the engine. The amount of mixture injected can be determined, in one embodiment, by an algorithm executed by the microprocessor. Other embodiments and methods can employ software or hardware to perform this or other functions adapted to help determine the amount of mixture to inject. One algorithm can incorporate user-supplied parameters into the mixture-injection calculation. By using an algorithm based upon user-supplied parameters, the amount of mixture injected into the system can generally automatically and continually maximize cooling, limit detonation, and increase power output without the need to manually adjust system parameters.

In one embodiment, a user can (i) adjust system variables including, but not limited to, mixture input level, (ii) perform mechanical component adjustment of the system, and (iii) adjust user-supplied input parameters to further maximize cooling, limit detonation, and increase horsepower. It is to be appreciated that some parameters can be adjusted through the system monitor on a real-time or near real-time basis.

In one embodiment, a user can change mechanical components including, but not limited to, nozzles and pumps to further increase horsepower, limit detonation, and maximize cooling.

Terminology

The terms and phrases as indicated in quotation marks (“ ”) in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term “or” as used in this specification and the appended claims is not meant to be exclusive; rather the term is inclusive, meaning either or both.

References in the specification to “one embodiment”, “an embodiment”, “another embodiment, “a preferred embodiment”, “an alternative embodiment”, “one variation”, “a variation” and similar phrases mean that a particular feature, structure, or characteristic described in connection with the embodiment or variation, is included in at least an embodiment or variation of the invention. The phrase “in one embodiment”, “in one variation” or similar phrases, as used in various places in the specification, are not necessarily meant to refer to the same embodiment or the same variation.

The term “couple” or “coupled” as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The term "integrate" or "integrated," as used in this specification and the appended claims, refers to a blending, uniting, or incorporation of the identified elements, components or objects into a unified whole.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

The term "software," as used in this specification and the appended claims, refers to programs, procedures, rules, instructions, and any associated documentation pertaining to the operation of a system.

The term "firmware," as used in this specification and the appended claims, refers to computer programs, procedures, rules, instructions, and any associated documentation contained permanently in a hardware device and can also be flashware.

The term "hardware," as used in this specification and the appended claims, refers to the physical, electrical, and mechanical parts of a system.

The term "mixed gas stream," as used in the specification and the appended claims, refers to any gas stream containing more than one component, in which at least one component is condensable at atmospheric pressure or at the operating pressure of the system.

The term "mixture," as used in this specification and the appended claims, refers to an injection solution comprising water and alcohol. For example, a mixture can comprise 50% water and 50% methanol.

The term "wall," as used in this specification and the appended claims, refers to any structure for containing the mixed gas stream and having capillary condensation pores for selectively permitting the passage of liquid through the pore.

The terms "computer-usable medium" or "computer-readable medium," as used in this specification and the appended claims, refers to any medium that can contain, store, communicate, propagate, or transport the program for use by or in connection with the instruction execution system, apparatus, or device. The computer-usable or computer-readable medium may be, for example but not limited to, an electronic, magnetic, optical, electromagnetic, infrared, or semiconductor system, apparatus, device, or propagation medium. By way of example, and not limitation, computer readable media may comprise computer storage media and communication media.

The term "signal," as used in this specification and the appended claims, refers to a signal that has one or more of its characteristics set or changed in such a manner as to encode information in the signal.

One Embodiment of a Water/Alcohol Injection Tuning System including a Liquid Reclamation System Embodiments of a water/alcohol injection system 10 can be adapted to inject water, an alcohol such as, but not limited to, methanol, a mixture of water and alcohol, or other liquids into an internal combustion engine. The injection system 10 can further include a liquid reclamation system 100 adapted to reclaim water from exhaust gasses. Generally, the water/alcohol injection system 10 can be implemented with a vehicle having an internal combustion engine. For example, the injection system 10 and the liquid reclamation system 100 can be implemented with a diesel engine.

The water/alcohol injection system 10 generally comprises a system monitor 12 and a control module 14. The system monitor 12 generally includes a display screen 20. It is to be appreciated that the display screen 20 can include, but is not limited to, an LCD, an OLED, an AMOLED, and a TFT screen. In an embodiment, the screen 20 can be adapted to display different injection system parameter levels.

Figure 7A:
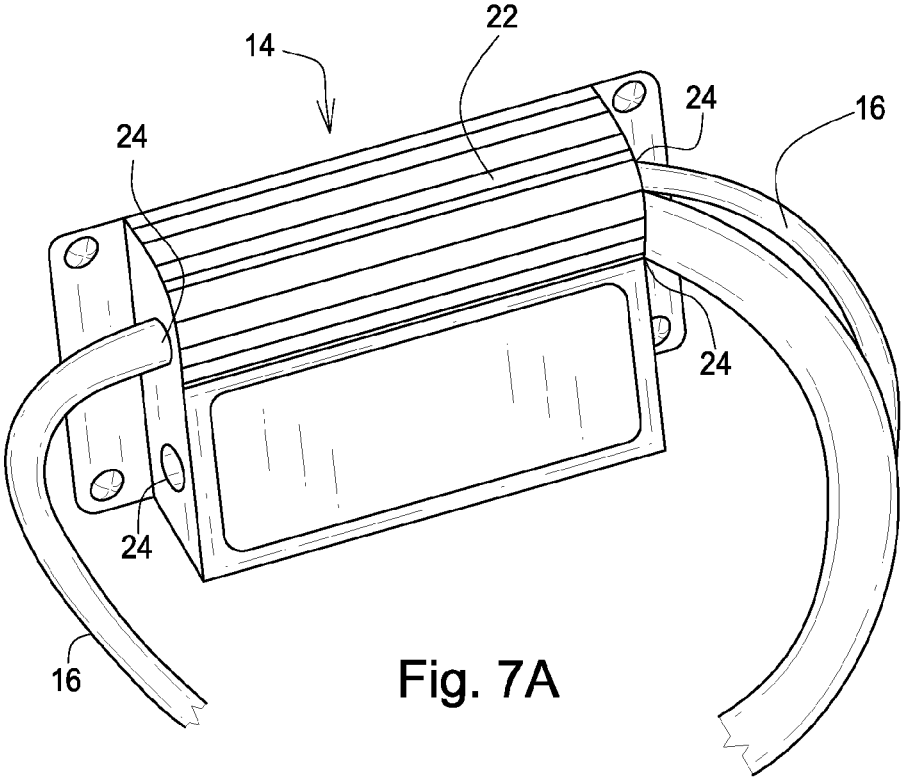
FIG. 7A is an isometric view of an installed control module according to one embodiment of the present invention.
Figure 7B:
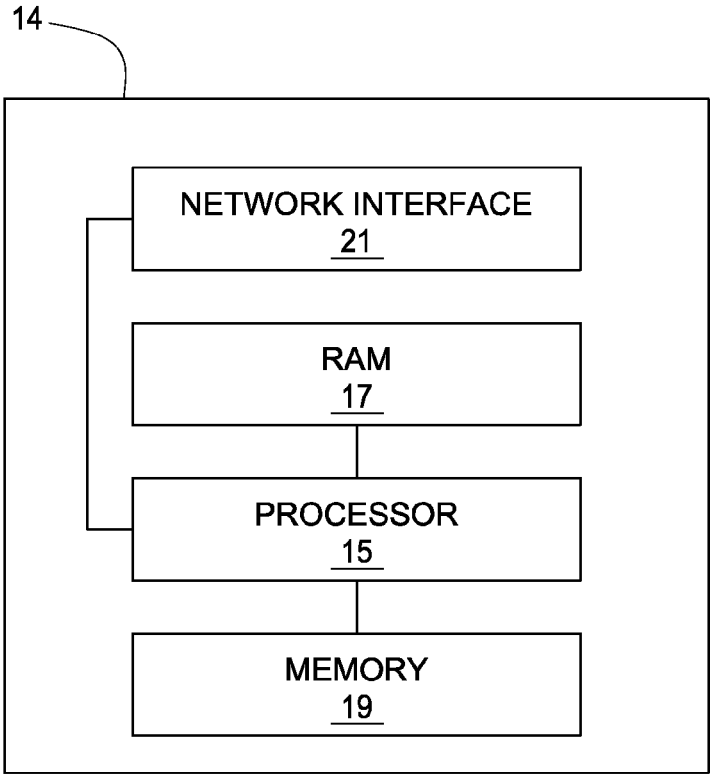
FIG. 7B is a block diagram of a control module according to one embodiment of the present invention.
Figure 8:
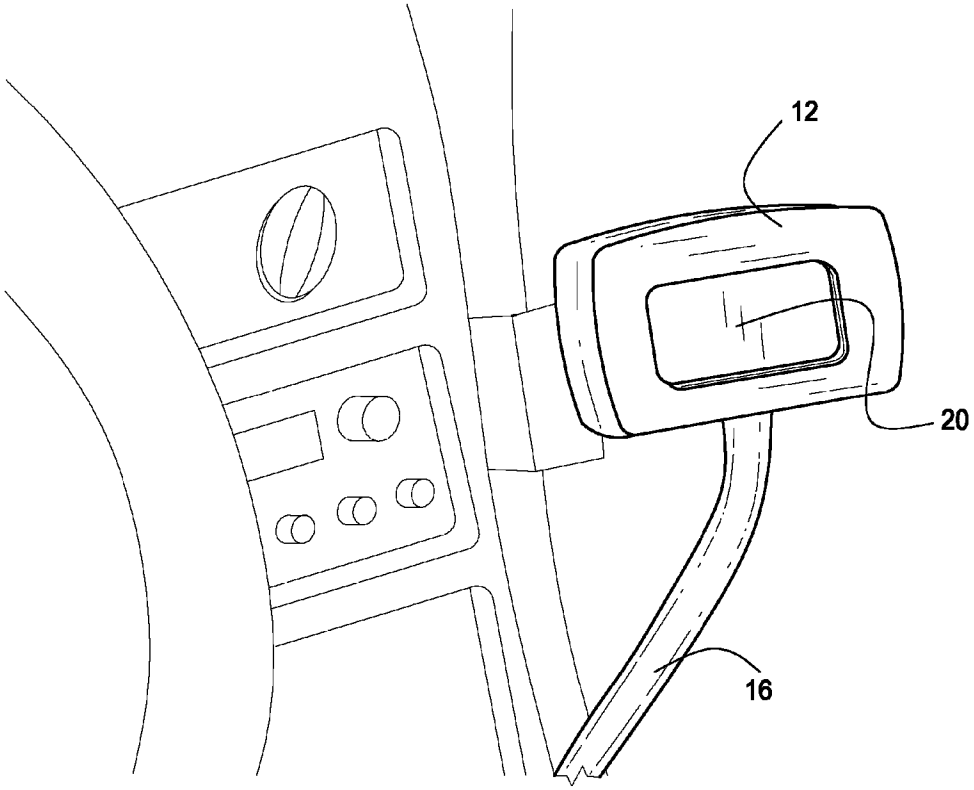
FIG. 8 is an isometric view of an installed system monitor according to one embodiment of the present invention.

As shown in FIG. 7A, the control module 14 is generally comprised of a housing 22 and a plurality of connectors 24. The control module 14 further includes a processor 15, random access memory 17, and nonvolatile storage 19 (or memory), as shown in FIG. 7B. The processor 15 can be a single microprocessor, multi-core processor, or a group of processors. The random access memory 17 can store executable code as well as data that may be immediately accessible to the processor 15, while the nonvolatile storage 19 can store executable code and data in a persistent state. The control module 14 can also include a network interface 21. The network interface 21 can include hardwired and wireless interfaces through which the control module 14 can communicate with other devices. For example, the control module 14 can wirelessly interface with sensors to receive information from various engine components.

Figures 5A, 5B:
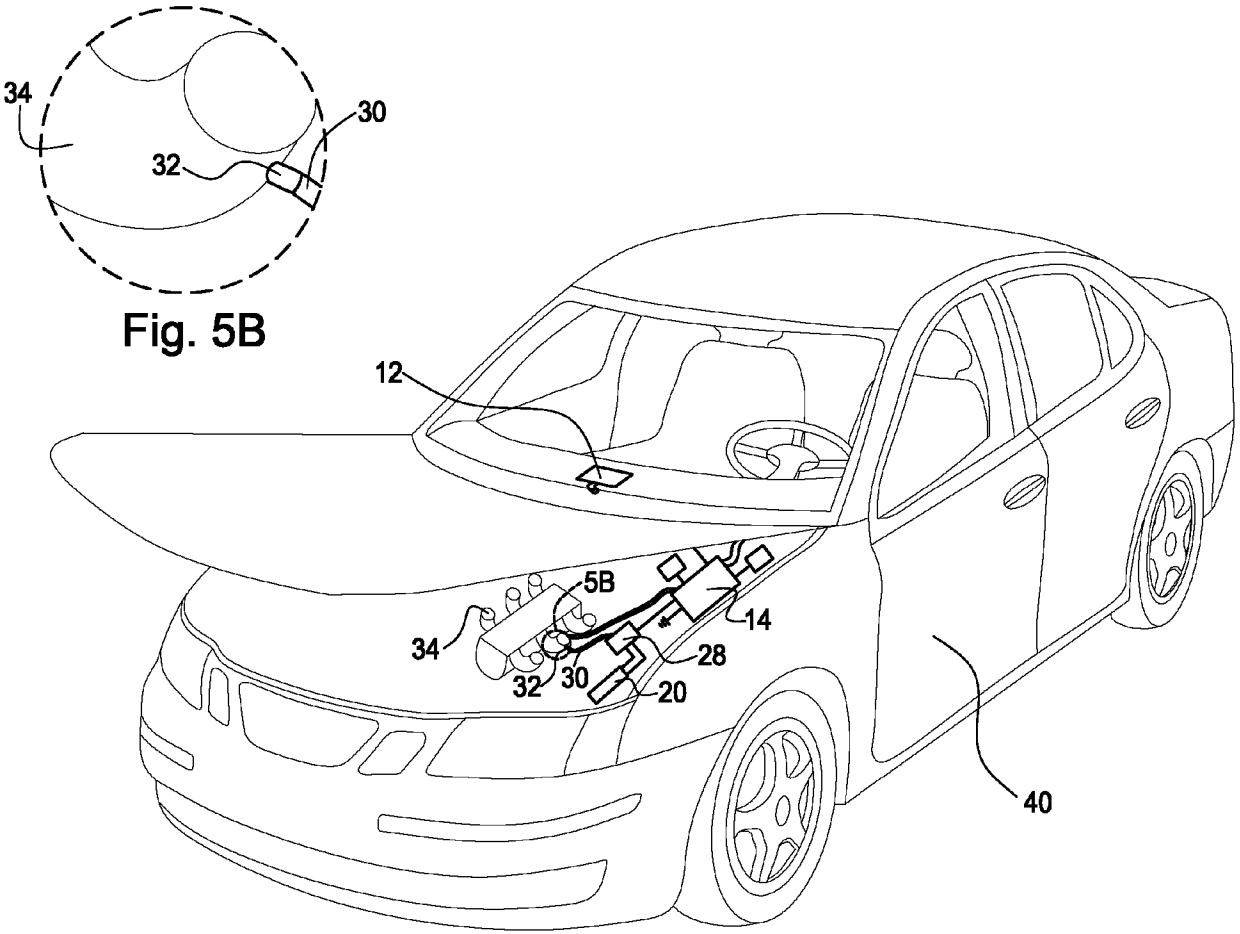
FIG. 5A is an isometric view of a vehicle with an installed injection system according to one embodiment of the present invention.
FIG. 5B is an isometric view of a manifold with a coupled nozzle and tubing according to one embodiment of the present invention.

In one embodiment, the control module 14 can be installed in an engine bay of a vehicle 40, as shown in FIG. 5A. The module housing 22 can be comprised of steel, steel alloy, aluminum, aluminum alloy, or another metal or material adapted to withstand extreme temperature swings within an engine bay. In one embodiment, the module housing 22 can be potted, such as a heat resistant epoxy material.

The microprocessor 15 can be adapted (e.g., through software, firmware, or otherwise) to determine an amount of mixture to inject into a vehicle's air intake chamber for a set of given engine parameters. The microprocessor 15 can be adapted to control signals sent and/or received by the connectors 24. In one embodiment, the signals can be controlled by software. It is to be appreciated that signals can be controlled by hardware, firmware, or similar means. In one embodiment, a software program can use an algorithm to determine which electrical signal is to be sent by the microprocessor 15. The algorithm can access user-supplied parameters to determine an appropriate signal to send. The software components can include an operating system on which various applications, algorithms, and programs may execute.

One of the connectors 24 can be adapted to operatively receive data input from a user. User data and signals sent and received by the microprocessor 15 can be used to determine an amount of mixture to input into the engine. The user data can be referred to as user-supplied input parameters, parameters, information, data, variables, or any other similar variation or wording. It is to be appreciated that other embodiments can use different mechanisms and electronic signal generators to perform this function.

The water/alcohol injection system 10 can also include one or more electrical wirings 16. The electrical wiring 16 can operatively couple to system components and can be adapted to allow electrical signals to pass between system components. For example, the electrical wiring 16 can operatively couple the control module 14 and the system monitor 12. It is to be appreciated that the electrical wiring 16 can couple to other system components. In some embodiments, the electrical wiring 16 can be replaced by wireless signals. For example, the control module 14 and the system monitor 12 can be connected via wireless signal technologies including, but not limited to, Bluetooth.

Figure 6:
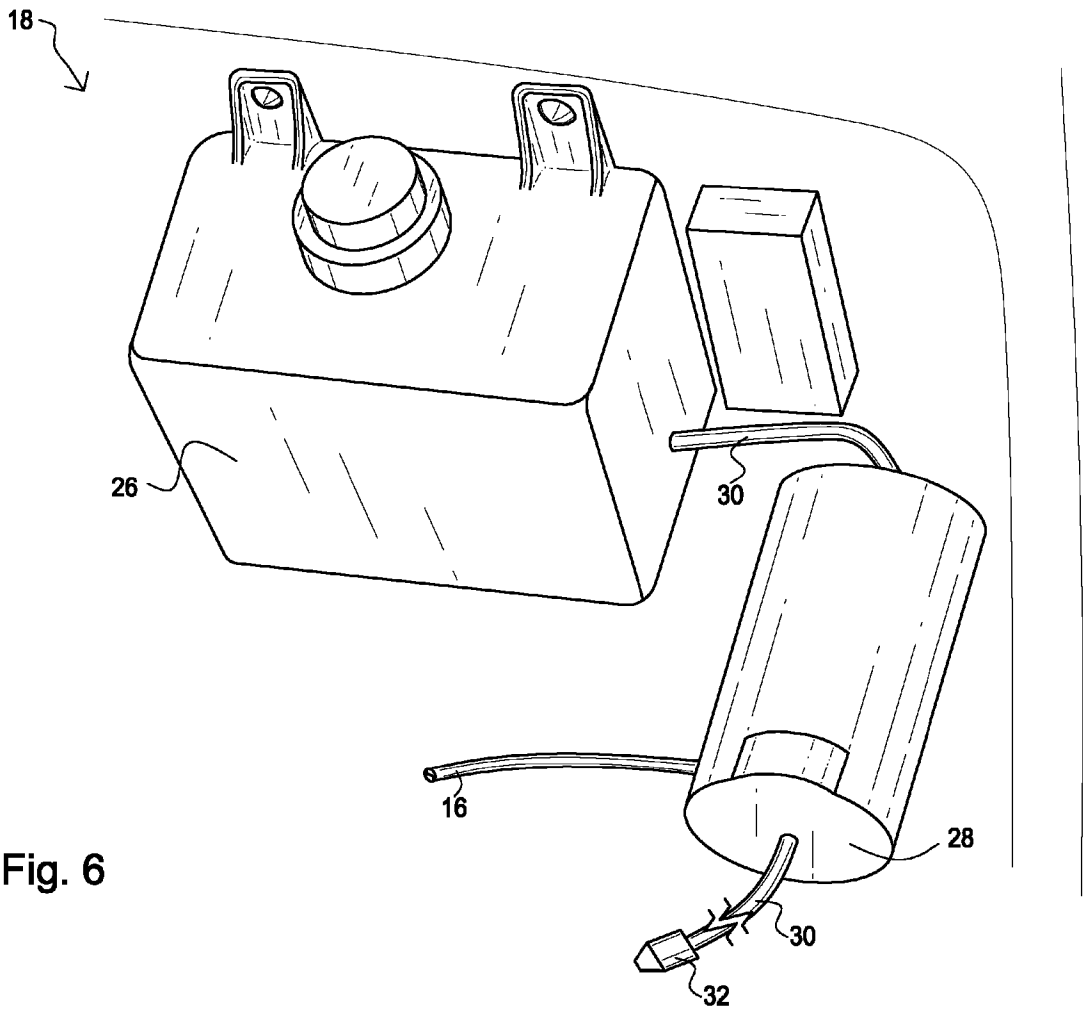
FIG. 6 is an isometric close-up view of a mixture delivery system according to one embodiment of the present invention.

As shown in FIG. 6, a mixture delivery system 18 can be included in the injection system 10. The mixture delivery system 18 is generally comprised of a reservoir tank 26, a pump 28, a plurality of tubing 30, and a nozzle 32. The pump 28 can be referred to as a pressure source. The reservoir tank 26 can be adapted to hold water, alcohol, a mixture of the two, or any other type of liquid. The reservoir tank 26 can send liquid to the pump 28 through the tubing 30. In one embodiment, the tubing 30 can be adapted to hold liquid under pressure. The pump 28 can then send liquid through the tubing 30 to the nozzle 32, which can inject liquid into an engine intake manifold 34.

As shown in FIG. 1A, the injection system 10 can further include a liquid reclamation system 100. The reclamation system 100 generally comprises a nano-pore membrane 102 and liquid recovery reservoir 106. The nano-pore membrane 102 can be implemented to line the inside of an exhaust and/or muffler pipe(s) 104 of a vehicle. In one example, the nano-pore membrane 102 can be adapted to line an exhaust pipe of a diesel engine.

Generally, water in exhaust gasses condense on a surface of the membrane 102 and can be pulled from there by capillary condensation into the reservoir 106. Depending on an embodiment, a small pump 112 can be implemented to assist in pulling water from the membrane 102 into the recovery reservoir 106 and onto the reservoir tank 26. Generally, the recovery reservoir 106 and the small pump 112 can be installed approximate the exhaust pipe 104. In some embodiments, capillary condensation can be implemented without mechanical intervention. The small pump 112 can be implemented to periodically pump reclaimed water from the recovery reservoir 106 to the reservoir tank 26 through one or more tubes 108 and 110. In an embodiment, the control module 14 can interface with one or more fluid level sensors in one or both of the reservoirs to facilitate operation of the small pump 112 when necessary. It is to be appreciated that the small pump 112 can interface with the fluid level sensors directly. Overflow tubes can be provided on either or both reservoirs to drain excess reclaimed water as necessary.

The nano-pore membrane 102 is similar to the apparatus described in U.S. Nonprovisional application Ser. No. 13/071,223 (hereinafter "the '223 application"), filed on 24 Mar. 2011, which is herein incorporated by reference. As disclosed in the '223 application, the membrane 102 for separating a liquid from a mixed gas stream can include a wall having a first surface, a second surface, and a plurality of condensation pores. The pores extend through the wall, and have a first opening on the first face of the walk, a second opening on the second surface of the wall, and a pore size between about 2 nm to about 100 nm. The exhaust pipe 104 (or mixed gas stream passageway) can be in fluid communication with the first opening of the membrane 102.

The wall can comprise a porous support layer and a porous condensation layer. The capillary condensation pores of the condensation layer can have a pore size of between about 2 nm and about 100 nm. The pores of the porous support layer can have a pore size of between about 0.1 and 50 μm. The porous support layer can have a thickness between 0.1 mm and 4 mm, and the condensation layer can have a thickness of between 1 and 100 μm.

Generally, the recovery reservoir 106 can collect the liquid from the second opening of the membrane 102 and the small pump 112 can remove liquid from the recovery reservoir 106. The pressure difference between the recovery reservoir 106 and the mixed gas stream passageway 104 can be between about 1 and 14.7 psi.

The membrane 102 can also include a cooling assembly for cooling at least a portion of the wall. The cooling assembly can have a conductive component, wherein a thermal conductivity of the conductive component is at least 50 W/mK. For example, the conductive component can be a graphite foam. The cooling assembly can include a convective component. The convective component can be a fan for flowing air over at least a portion of the wall. In one embodiment, the apparatus can have a filter assembly positioned upstream of the pores to remove particulates from the mixed gas stream.

Figure 1B:
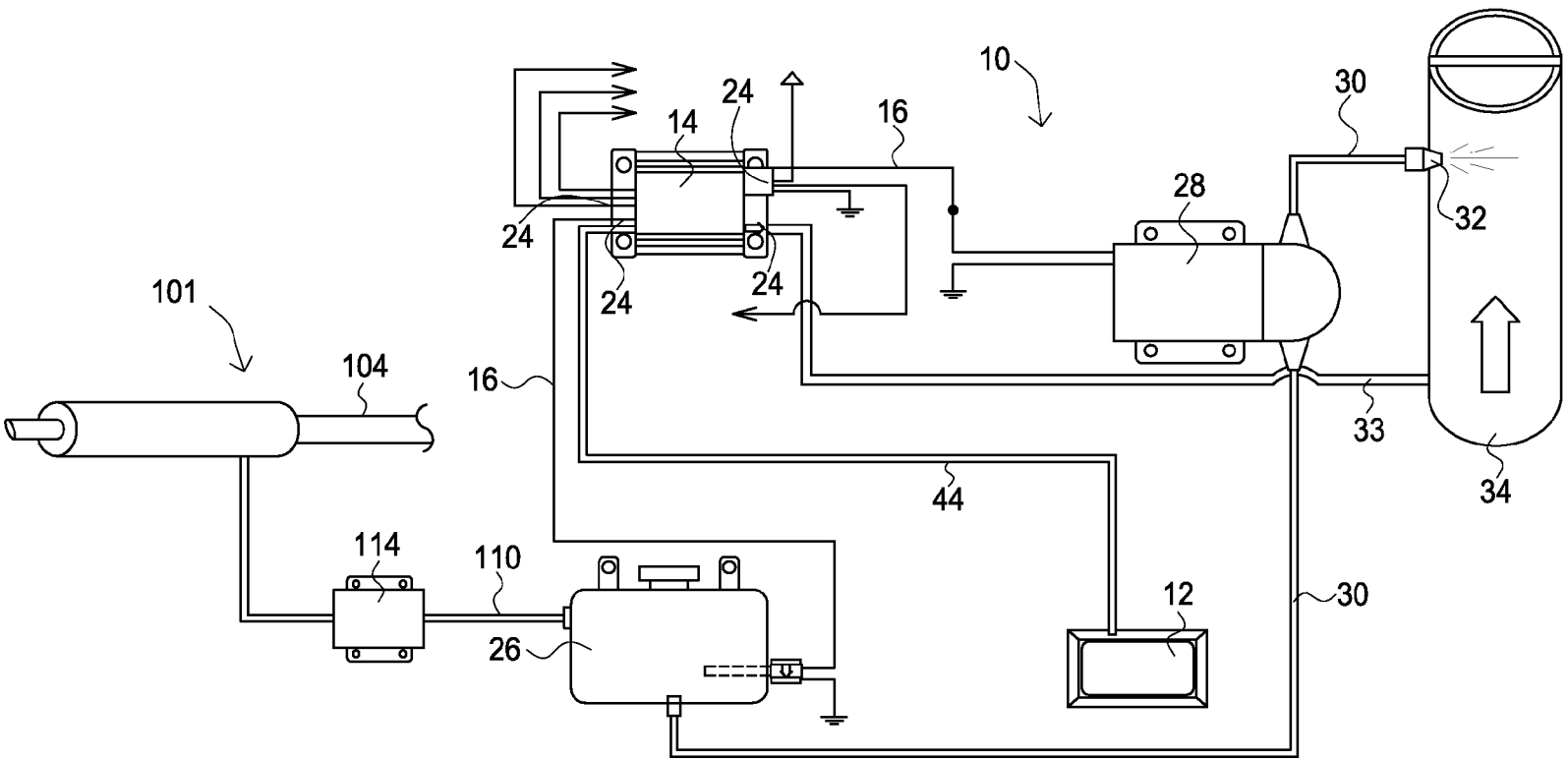
FIG. 1B is a diagram of a water/alcohol injection system coupled to an internal combustion engine according to an alternative embodiment of the present invention.

In one embodiment, as shown in FIG. 1B, a water reclamation system 101 can generally comprise the membrane 102 and the tank reservoir 26. Reclaimed water can be deposited or pumped directly into the reservoir tank 26 from the membrane 102. It is to be appreciated that a supplemental pump 114 can be implemented or only capillary condensation can be used. Other variations and methods of transporting reclaimed water from the membrane 102 on the exhaust 104 to the reservoir tank 26 are contemplated as would be obvious to one of ordinary skill in the art to which the invention pertains.

In some embodiments, the injection system 10 and the water reclamation system 100 can form a closed loop system. The water reclamation system 100 can be adapted to be the sole provider of water for the injection system 10. In such an embodiment, a user would not have to fill the reservoir tank 26 with water.

Some embodiments of the injection system 10 can include an alcohol tank (not shown). The alcohol tank can be adapted to fill the reservoir tank 26 with alcohol in addition to water from the recovery reservoir 106. When the alcohol tank is included, a mixture can be supplied to the intake manifold 34. In one embodiment, the reservoir tank 26 can include a mixture sensor that helps the control module 14 determine how much alcohol and water to pump into the reservoir tank 26. In some embodiments, it is anticipated that data parameters set by a user can determine a mixture best suited for a particular engine. After a user inputs data for the parameters, the control module 14 in conjunction with a mixture sensor can determine how much alcohol and water to pump into the reservoir tank 26 from the recovery reservoir 106 and the alcohol tank.

In one embodiment, an electronic signal can be operatively sent from the microprocessor 15 to the pump 28. The electronic signal can tell the pump 28 to send mixture to the operatively coupled nozzle 32 that is coupled to the air intake manifold 34. In an embodiment, the nozzle 32 can be coupled to the manifold 34 in a manner allowing the nozzle 32 to spray mixture into the manifold 34. In one embodiment, an electronic signal sent to the pump 28 can tell the pump 28 to operatively send a level of mixture from the reservoir tank 26 to the nozzle 32. In this manner, in one embodiment, based on the user-supplied parameters as well as other engine supplied data, an amount of mixture can be sprayed into the air intake manifold 34 in order to increase the vehicle's power.

The user supplied parameters used by the injection system 10 to determine an amount of mixture to inject into an engine includes, but are not limited to, an injection initiation point, an estimated maximum vehicle power level, number of injection devices, injection device type, and pump type. It is to be appreciated that other input parameters can be implemented with the injection system 10.

In one embodiment, an injection initiation point can include a predetermined boost pressure level. For example, the control module 14 can include one of the connectors 24 operatively coupled to read a pressure in the air intake manifold 34. Through a pressure gauge operatively coupled to the intake manifold 34 (or plenum), the amount of pressure in the manifold due to boost input such as, but not limited to, a turbo or supercharger device can be determined. The pressure level can be received by the microprocessor 15 by one of the connectors 24. In one embodiment, if the boost pressure level is above a user-specified boost pressure level, the control module 14 can operatively send a signal for the reservoir tank 26 to begin to release mixture to the engine. It is to be appreciated that other injection initiation points in addition to boost pressure level known in the art can be implemented.

In one embodiment, fluid level sensors located in the reservoir tank 26 and the recovery reservoir 106 can send signals to the control module 14 through one of the connectors 24. It is to be appreciated that wireless means of sending signals can be implemented including, but not limited to, Bluetooth, Wi-Fi, acoustic, RF, infrared and other wireless means. The control module 14 can be adapted to determine when to run the small pump 112 based on signals received from the fluid level sensors. For instance, when the control module 14 receives a signal from the fluid level sensor of the reservoir tank 26 that the tank 26 is low, the control module 14 can send a signal to the small pump 112 to pump liquid from the recovery reservoir 106 to the reservoir tank 26. In an embodiment, a fluid level switch can be implemented in the reservoir tank 26 to determine when to pump reclaimed water from the recovery reservoir 106 to the reservoir tank 26.

In an embodiment, the control module 14 stores system parameters on the nonvolatile storage 19. It is to be appreciated that other embodiments can implement a variety of mechanisms or methods to store the parameters such as, but not limited to, hardware and/or software. The microprocessor 15 can receive user supplied system parameters from the operatively coupled system monitor 12. In one embodiment, the system monitor 12 can be comprised of a liquid-crystal display (LCD) adapted to receive inputs from a user. The user can enter data on the screen via touch screen capabilities. In one embodiment, when the injection system 10 is installed and powered on, the system monitor 12 can receive power, changing the screen 20 from an "off" mode, where the screen 20 is blank, to an "on" mode, where graphical representations are on the screen 20.

When the system monitor 12 is in the on mode, the user, through a stylus or otherwise, can select, possibly through different screen choices, the ability to enter data into the injection system 10. For instance, the user can set the injection initiation point at a pressure level which is about of ⅓ the maximum boost pressure level for the boost system installed on the vehicle using the system monitor 12. For example, a vehicle having a turbocharger installed with a boost controller and a spring able to achieve a maximum boost pressure level of 15 psi, the mixture can be introduced into the engine when the boost pressure reaches 5 psi.

The user can enter estimated maximum power levels and injection device information on the system monitor 12. Estimated maximum power levels are generally comprised of an estimated flywheel horsepower of the engine. Alternatively, another power level reading or readings can be implemented. Injection device information including, but not limited to, the number and type of nozzles 32 coupled to the intake manifold 34, can be entered into the system monitor at this point. It is to be appreciated that other parameters known in the injection art can be entered.

When system parameters are set and the control module 14 receives a signal that the injection initiation point has been reached by the engine, the injection system 10 can begin to initiate injection flow. To determine the level of mixture that is sent to the engine, the algorithm implemented by the software stored on the nonvolatile storage 19 can incorporate factors including, but not limited to, the boost pressure level and one of injector duty cycle level and exhaust gas temperature.

In one example, a data cable 33 can connect a pressure sensor in the intake manifold 34 to the control module 14. One of the connectors 24 of the control module 14 can receive a boost pressure level from the sensor in the manifold 34 and supply the information to the microprocessor 15. Software executed by the microprocessor 15 can calculate the injector duty cycle as well. Injector duty cycle can be determined with information including, but not limited to, engine speed (rpm) and injector pulse width. In one embodiment, the injector duty cycle, displayed on the system monitor 12 as a percentage of time the injector is being utilized, can be used in conjunction with the boost pressure to determine the amount of mixture that is injected into the engine. The information needed to determine the injector duty cycle can be supplied to the control module 14 from an operatively coupled fuel injector through the electrical wiring 16.

In an alternative embodiment, for instance a diesel adapted embodiment, the amount of mixture to inject into the engine can be based on a boost pressure level and exhaust gas temperatures (EGTs). Like an injector duty cycle embodiment, the exhaust gas temperature embodiment can utilize both boost and EGTs to modulate injection. The EGTs can be sent form a temperature probe. One type of temperature probe is a k-type probe mounted to receive temperature from an exhaust manifold in a pre-turbo location. A probe can be comprised of a shielded lead about ten inches long adapted to couple to a control module connector. The system monitor 12 can display the EGT level.

In one embodiment, besides being capable of receiving, sending, and displaying user-supplied parameters, the system monitor 12 can display and adjust other system information. For example, the screen 20 can display an injection parameter. For example, the injection parameter displayed can be a pump output percentage. In another example, the injection parameter displayed can be an injection flowrate. The injection flowrate can be displayed as ml/min. In one embodiment, the injection flowrate can be displayed if a safety device is operatively coupled to the control module 14.

A gain parameter can be displayed and adapted to be adjusted on the system monitor 12. In one embodiment, the gain parameter can be displayed as a percentage increase or decrease in the injection flowrate as determined by the algorithm. In another embodiment, the gain parameter can be displayed as an injection curve. The injection curve information can be stored on the nonvolatile storage 19. It is to be appreciated that other means to set the injection flowrate are contemplated. The gain parameter allows a user to increase or decrease the injection amount by fifteen percent. As such, the gain parameter can allow the user to more fully (and manually) optimize the injection system 10 and can allow a user to increase or decrease mixture injection in real-time while injection is occurring. In one embodiment, such as, but not limited to, a diesel embodiment, the gain parameter can be displayed in a 100 percent display range, allowing a user to adjust the gain above or below the maximum gain level.

In an embodiment, the system monitor 12 can allow a user to configure the injection system 10 for use with up to three injection devices. Generally, an injection device can include the spray nozzle 32 and tubing 30. A user can configure each of the injection devices for a nozzle size from "NONE" to 625 ml/minute. Additionally, the user can determine a size of the pump 28 depending on the number of injection devices attached.

In an embodiment, the system monitor 12 can be adapted to set display parameters including, but not limited to, screen brightness, screen contrast, volume, and other display parameters.

In one embodiment, information received by the system monitor 12 can be stored by the control module 14. In one example, the control module 14 can include a communication harness connector 24 adapted to receive a wire communication harness 44. The wire communication harness 44 can be operatively coupled to the system monitor 12.

The connectors 24 of the control module 14 can be implemented to connect to a variety of devices. For example, one of the connectors 24 can be operatively coupled to a fluid level switch adapted to receive a signal when a mixture fluid level reaches a specified amount in the reservoir tank 26. The signal can be sent to the microprocessor 15 in one embodiment, and the microprocessor 15 can initiate a signal sent to the system monitor 12. The system monitor 12 can receive the signal and display an icon or other display on the LCD screen 20 to inform the user that a specified fluid level has been reached. In one embodiment, the system monitor 12 can emit a sound. It is to be appreciated that the control module 14 can receive a fluid level signal from the reservoir tank 26.

Another one of the connectors 24 can be a power output connector. Generally, the power output connector can drive a solenoid, a NOS relay, and/or a safety device including, but not limited to, a SafeInjection™ Unit. The SafeInjection™ unit can be a unit that sends a signal to a blow off valve solenoid to evacuate boost if mixture flow is retarded. Other connectors 24 can be adapted to couple to another safety unit. For example, if a safety device sends a signal that a system fault has occurred, the connector can receive the signal, send the signal to the microprocessor 15, and a signal can be sent to the system monitor 12 to display an icon and can also emit a sound.

In one embodiment, one of the connectors 24 can be a flow signal connector. The flow signal connector can receive a signal from a flowmeter and the signal can be operatively sent to the system monitor 12. In response to the signal from the flowmeter, the system monitor 12 can display the mixture flowrate in ml/minutes. It is to be appreciated that displaying other system parameters is contemplated.

One Method of Injecting a Liquid into an Internal Combustion Engine

As best shown in FIGS. 1-4, a method of injecting a liquid into an internal combustion engine can be comprised of using the injection system 10 and the liquid reclamation system 100. The injection system 10 is generally comprised of the system monitor 12, the control module 14, electrical wiring 16, the plurality of connectors 24, the reservoir tank 26, the pump 28, and the nozzle 32. The method can include injecting water, an alcohol including, but not limited to, methanol, or a mixture of water and alcohol into the engine intake manifold 34. It is contemplated that the method can use other liquids as well. The liquid reclamation system 100 is generally comprised of the nano-pore membrane 102, the recovery reservoir 106, and the small pump 112.

In one method, the control module 14, the tank 26, and the pump 28 can be installed into an engine bay of a vehicle such as, but not limited to, an automobile. The system monitor 12 can be installed in a passenger compartment such as, but not limited to, the dashboard of a vehicle. The nano-pore membrane 102 can be installed in an exhaust pipe of the vehicle. The recovery reservoir 106 and the small pump 112 can be installed approximate the exhaust pipe. Generally, the tube 110 can be implemented to connect the water reclamation system 100 to the injection system 10.

In one method, the nano-pore membrane 102 can reclaim water from exhaust gasses of an internal combustion engine. For example, the water can be reclaimed by capillary condensation. Typically, the reclaimed water is stored in the recovery reservoir 106. In some methods, the small pump 112 can be implemented to move reclaimed water from the recovery reservoir 106 to the reservoir tank 26 of the injection system 10. It is to be appreciated that other setups are contemplated including, but not limited to, the reclaimed water stored directly in the recovery reservoir 26 and the injection system 10 utilizing the recovery reservoir 106 to inject water into the intake manifold 34.

In one method, the water reclamation system 100 can provide enough water for the injection system 10 to be a closed system. For example, once installed, the water reclamation system 100 can collect enough water from exhaust gasses to provide the reservoir tank 26 with sufficient water so that a user would not have to fill the tank 26 during operation of the injection system 10.

Installation can include a method step of providing power to the system through a key-on source. In one method, when a car is powered on, the system can receive power, powering on the system monitor 12. The system monitor 12 can power on by displaying information on a liquid crystal display (LCD) 20.

Figure 2:
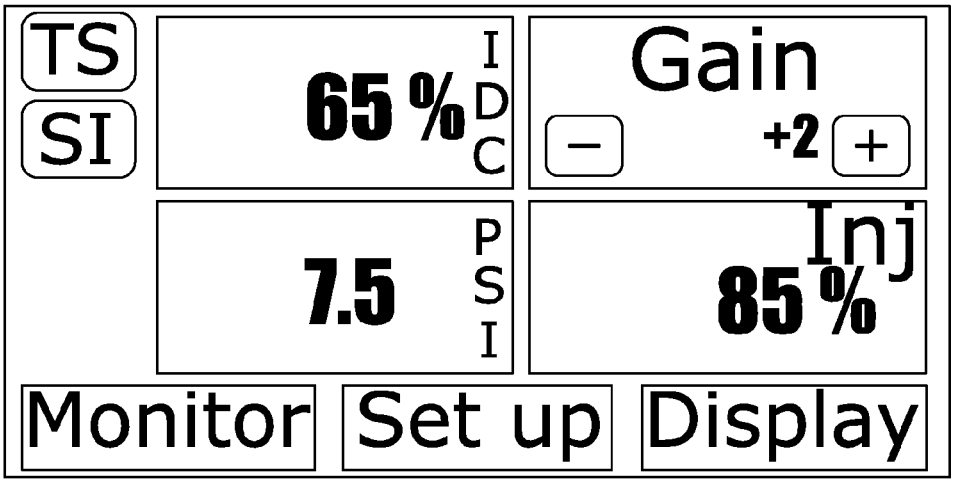
FIG. 2 is a front view of a system monitor screen showing the "Monitor" menu according to one embodiment of the present invention.
Figure 3:
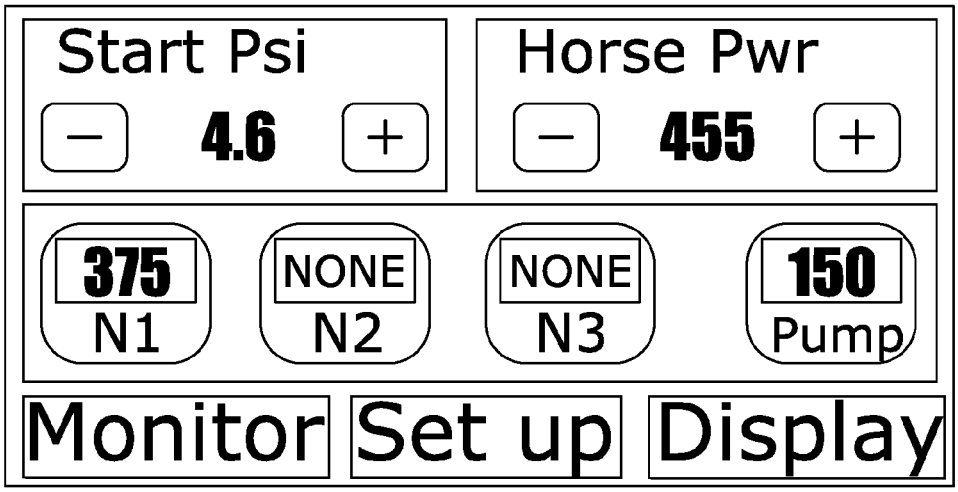
FIG. 3 is a front view of a system monitor screen showing the "Set Up" menu according to one embodiment of the present invention.
Figure 4:
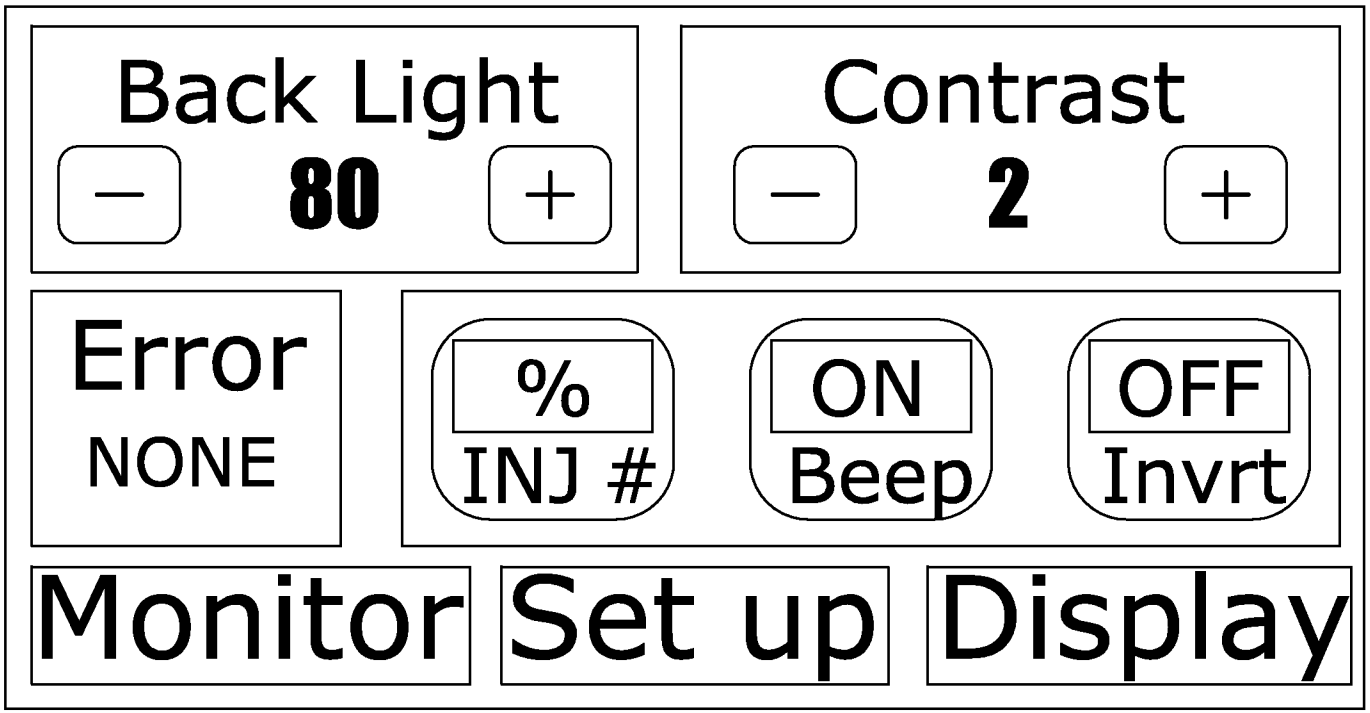
FIG. 4 is a front view of a system monitor screen showing the "Display" menu according to one embodiment of the present invention.

As best shown in FIGS. 2-4, three screens can be displayed on the system monitor. One screen, as best shown in FIG. 2 can be the Monitor screen. In one Monitor screen, the Injection Duty Cycle (IDC), Gain level, Boost Pressure, and Injection can be shown. The IDC can be shown as a percentage of the injector's on-time per engine revolution. Boost pressure can be shown in psi and a maximum psi displayed can be 30 psi in one embodiment. Additionally, the Injection can be shown as a mixture injection amount displayed as a percentage of the pump output or in a ml/min flowrate.

The Monitor screen can also display system icons. For example, as best shown in FIG. 2, the Monitor screen can have a Test System (TS) icon. When the TS icon is pressed, in one embodiment, the injection system will override normal operation and drive the pump at 50% of maximum. This can be done in order to determine if the system is properly installed. For example, upon pressing the TS icon, in one embodiment, the engine can bog or stumble and the user can then turn the engine off to inspect the stem for any fluid leaks. If the engine does not stumble or bog, electrical connections and fluid lines can be checked for proper installation, repaired, and the system can be checked again.

Other system icons can also be displayed on the system monitor 12. One icon can be an Error (ER) icon. One ER icon can be displayed if the system detects an error. A user can then switch to a Display Screen, as best shown in FIG. 4, to determine the error code associated with the ER icon. For instance, the Display Screen can display a "pump", "I+12", "Comm", and "SI" error codes. The "pump" error code can inform a user that the pump is clogged or faulty. An "I+12" code can inform a user that a connector is not receiving a proper signal. In one embodiment, an option or auxiliary connector such as, but not limited to, a twelve volt power output connector can not be operating properly due to a shorted wire, a failed device, or otherwise. A "Comm" error can inform a user that a communication error has occurred between the control module 14 and the system monitor 12, while the "SI" code can inform the user that a coupled safety device, such as the SafeInjection™ system, has tripped an injection flow fault.

In addition to error codes, the Monitor screen can display two additional icons—the FL and SI icon. The FL icon can be displayed and the system monitor can beep when the system detects a low fluid condition. Also, the SI icon can be displayed and the system can beep in the event the safety unit such as the SafeInjection system detects a fault.

As best shown in FIG. 3, the Set up screen can display "Start Psi", "Horse Power", "Nozzle Selection", and "Pump". The "Start Psi" can be the boost pressure for when the injection system 10 will activate. The "Horse Power" can be the estimated flywheel horse power of the vehicle. "Nozzle selection" can include configuring up to three nozzles and the "Pump" can allow selection between different pumps.

As best shown in FIG. 4, the Display screen can display "Back Light", "Contrast", "INJ #", "Beep", and "Invrt", besides displaying the Error codes discussed earlier. The "Back Light" function adjusts the intensity of the display. The "Contrast" adjusts the contrast of the display. The "INJ #" can allow a user to toggle between "%" and "ml" which can change the Injection display on the Monitor screen. "Beep" can turn on and off a speaker on the system monitor 12. "Invrt" is an option which allows a user to invert the coloring on the system monitor 12 display 20.

In one method, the LCD can allow a person to set an injection initiation point. For example, when the system is powered on, the system monitor 12 can display a "Set up" screen. In the "Set up" screen, a user can enter at what engine parameter or parameters the injection system 10 can begin to inject liquid into an engine component to increase engine power output. For example, as best shown in FIG. 3, a user can set "Start Psi" as an injection initiation point. The "Start Psi" can be a boost pressure level measured in pounds per square inch (psi). A boost pressure level can be determined by operatively coupling the intake manifold 34, or plenum, to a control module 12 in a manner adapted to allow an injection system component to read the pressure and save the pressure to the control module 14.

A method to inject a liquid into an internal combustion engine can also include a user inputting one or more set-up parameters to the system. The parameters in one embodiment can be input through a system monitor 12 component such as, but not limited to, the LCD. The method can also include a step of storing the parameters. For example, upon receiving the parameters, the system monitor 12 can electronically transfer the data received from the user to the control module 14. In one embodiment, the control module 14 can store the parameters within the nonvolatile storage 19. However, other control module storage devices such as, but not limited to, software or a hardware device or devices can also be used.

Upon receiving and storing the input parameters to the system, the system is adapted to, and subsequently does, receive engine-supplied information. For example, when the control module 14 is operatively coupled to an intake manifold 34 of an engine, which can include an electrical or mechanical coupling method and a pressure gauge, the pressure gauge can supply the control module 14 with the boost pressure. One type of boost pressure can be the pressure supplied to the intake manifold from an installed turbocharger. Other boost devices such as, but not limited to, a supercharger can also be employed.

When the control module 14 receives engine-supplied information such as, but not limited to, the boost pressure, the control module 14 can send a signal to initiate a mixture supply to the engine. For example, when the control module 14 receives the boost pressure from the engine air intake manifold 34, the pressure level can be sent to the microprocessor 15. The microprocessor 15 can determine if the boost pressure or other engine-supplied information is at a level where the control module should send a signal to the mixture delivery system initiating mixture supply to the engine. The control module 14 can use a program such as, but not limited to, a software program, to determine the amount of liquid to inject into an engine component. The mixture can be supplied to an engine's metal air inlet tube as close as possible to the throttle body when the boost pressure level is higher than the injection initiation point such as, but not limited to, the "Start Psi".

One method supplies mixture to the intake manifold 34 by receiving power from an engine key-on source. For example, a control module 14 can have a connector 24 which is adapted to receive 12V of electrical power from the engine. The control module 14 can receive the power when the engine is powered on. The control module 14 can then supply power to the pump 28 and the system monitor 12.

Upon the system powering on and the control module 14 receiving a signal to begin initiating a mixture supply to the engine, the control module 14 can send a signal to an operatively coupled pump 28 in one method. The signal to the pump 28 can allow an operatively coupled reservoir tank 26 to initiate sending one or both of water and alcohol, or any other liquid, to an operatively coupled nozzle 32. The nozzle 32 can be adapted to inject, and can sprayingly inject, the liquid into an engine component such as, but not limited to, the air inlet tube.

The injection system 10 can calculate a liquid amount to inject which generally maximizes the engine's power output. For example, in one method, a software program can access user supplied data such as, but not limited to, the injection initiation point, estimated power level, number of injection devices, injection device type, and pump type to determine an amount of liquid to inject. The software can also receive other information supplied to the control module 14. For example, the software can use injection flowmeter data supplied to the control module 14 from an engine component such as, but not limited to, a fuel injector. In one method, the software utilizes an algorithm which uses at least some of this information in automatically determining the signal to send from the control module 14 to the pump 28 so the pump 28 can inject the correct amount of liquid from the nozzle 32. In this manner, the injection system 10 performs an automatic tuning of the system upon installation. In another method, a user can manually adjust the ignition timing of the vehicle that the system 10 is installed in, or perform other tuning functions to manually increase the power output or lower the temperature of the engine.

An algorithm can be implemented to receive real-time or near real-time data from the engine. The control module 14 can receive two real-time or nearly real-time parameters from an engine component or another injection system component. One parameter can be the boost and one can be the injector pulse width. The system 10 can also use the exhaust gas temperatures in one method. A method can initiate injection into the engine at or about at ⅓ the maximum boost pressure for the boost device or devices on the engine. One method can also automatically set the mixture injection initiation point (through software or through input from an ECU or through inputting other parameters such as, but not limited to, type of car, engine, etc.).

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A liquid injection system comprising:
- a system monitor having a display screen;
- a control module operatively coupled to the system monitor;
- a mixture delivery system; and
- a liquid reclamation system operatively coupled to the mixture delivery system, the liquid reclamation system including:
  - a nano-pore membrane lining an interior of an exhaust pipe of an internal combustion engine;
  - a first reservoir adapted to collect water reclaimed by the nano-pore membrane; and
  - a first pump adapted to send water from the first reservoir to a second reservoir;
- wherein the nano-pore membrane uses capillary condensation to recover water from exhaust gasses of the internal combustion engine.

2. The injection system of claim 1, wherein the mixture delivery system comprises:
- a nozzle;
- a second pump operatively coupled to the control module; and
- the second reservoir operatively coupled to the second pump.

3. The injection system of claim 2, wherein the control module is adapted to automatically control water sent from (i) the first reservoir to the second reservoir, (ii) the second reservoir to the second pump, and (iii) the second pump to the nozzle.

4. The injection system of claim 2, wherein the first reservoir and the second reservoir each include a fluid level sensor.

5. The injection system of claim 4, wherein the control module activates the first pump based on a signal received from one of the fluid level sensors.

6. The injection system of claim 2, wherein the second reservoir includes an overflow tube.

7. The water reclamation system of claim 2, wherein the first reservoir and the second reservoir each include an overflow tube.

8. The injection system of claim 1, wherein the screen is a touch-screen adapted to receive input from a user.

9. The injection system of claim 8, wherein the control module activates the first pump based on input received from the user.

10. The injection system of claim 1, wherein the screen is adapted to display a fluid level of the first reservoir and the second reservoir.

11. A liquid injection system comprising:
- a mixture delivery system comprising:
  - a nozzle;
  - a first pump; and
  - a first reservoir operatively coupled to the first pump;
- a liquid reclamation system operatively coupled to the mixture delivery system, the liquid reclamation system comprising:
  - a nano-pore membrane lining an interior of an exhaust pipe of an internal combustion engine, wherein the nano-pore membrane uses capillary condensation to recover water from exhaust gasses of the internal combustion engine;
  - a second reservoir adapted to collect water reclaimed by the nano-pore membrane; and
  - a second pump adapted to send water from the second reservoir to the first reservoir;
- a control module operatively coupled to the mixture delivery system and the liquid reclamation system.

12. The injection system of claim 11, wherein the control module is adapted to automatically control water sent from (i) the second reservoir to the first reservoir, (ii) the first reservoir to the first pump, and (iii) the first pump to the nozzle.

13. The injection system of claim 12, wherein the first reservoir and the second reservoir each include a fluid level sensor.

14. The injection system of claim 13, wherein the control module activates the second pump based on a signal received from one of the fluid level sensors.

* * * * *